US009045312B2

(12) United States Patent
Puranen et al.

(10) Patent No.: US 9,045,312 B2
(45) Date of Patent: Jun. 2, 2015

(54) ARRANGEMENT FOR DAMPING LATERAL SWAYS OF A ROPE FIXED TO AN ELEVATOR UNIT AND AN ELEVATOR

(71) Applicant: KONE Corporation, Helsinki (FI)

(72) Inventors: Mikko Puranen, Helsinki (FI); Tuomo Ropponen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/162,842

(22) Filed: Jan. 24, 2014

(65) Prior Publication Data

US 2014/0224590 A1 Aug. 14, 2014

(30) Foreign Application Priority Data

Feb. 12, 2013 (FI) ..... 20135124

(51) Int. Cl.
*B66B 1/34* (2006.01)
*B66B 5/02* (2006.01)
*B66B 7/06* (2006.01)

(52) U.S. Cl.
CPC . *B66B 5/02* (2013.01); *B66B 7/068* (2013.01); *B66B 5/022* (2013.01); *B66B 7/064* (2013.01); *B66B 7/06* (2013.01)

(58) Field of Classification Search
CPC ..... B66B 1/24; B66B 5/0018; B66B 5/02; B66B 5/022; B66B 5/12; B66B 7/06; B66B 7/064; B66B 7/068; B66B 7/10; B66B 7/1207; B66B 7/1223; B66B 7/1261
USPC ..... 187/247, 254, 264, 391, 393, 401, 404, 187/409–412, 414
See application file for complete search history.

(56) References Cited

U.S. PATENT DOCUMENTS

| | | | | | |
|---|---|---|---|---|---|
| 3,768,596 | A * | 10/1973 | Solymos | 187/254 |
| 3,882,968 | A * | 5/1975 | Suozzo | 187/264 |
| 4,079,816 | A * | 3/1978 | Ohta | 187/414 |
| 4,716,989 | A * | 1/1988 | Coleman et al. | 187/411 |
| 5,377,296 | A * | 12/1994 | Greenway et al. | 388/816 |
| 5,861,084 | A * | 1/1999 | Barker et al. | 187/264 |
| 6,364,063 | B1 * | 4/2002 | Aulanko et al. | 187/266 |
| 6,712,183 | B2 * | 3/2004 | Otsuka et al. | 187/266 |
| 6,837,340 | B2 * | 1/2005 | Strauss et al. | 187/413 |
| 8,235,179 | B2 * | 8/2012 | Valjus et al. | 187/264 |
| 2004/0055831 | A1 | 3/2004 | Huber | |
| 2010/0065381 | A1 * | 3/2010 | Roberts et al. | 187/401 |
| 2011/0088980 | A1 | 4/2011 | Husmann | |

(Continued)

FOREIGN PATENT DOCUMENTS

| | | |
|---|---|---|
| JP | 03-013478 A | 1/1991 |
| JP | 05-186164 A | 7/1993 |

(Continued)

*Primary Examiner* — Anthony Salata
(74) *Attorney, Agent, or Firm* — Birch, Stewart, Kolasch & Birch, LLP

(57) ABSTRACT

An arrangement is provided for damping lateral sways of a rope fixed to a movable elevator unit, such as an elevator car in an elevator hoistway, the bottom end of which rope has an upward opening bottom loop. The arrangement includes a freely hanging damper supported on the top surface of the bottom loop, which damper includes a device for measuring acceleration and/or twisting of said rope.

17 Claims, 3 Drawing Sheets

(56) References Cited

U.S. PATENT DOCUMENTS

| | | | | |
|---|---|---|---|---|
| 2013/0020150 | A1* | 1/2013 | Ropponen et al. | 187/414 |
| 2014/0166406 | A1* | 6/2014 | De Jong et al. | 187/264 |

FOREIGN PATENT DOCUMENTS

| | | | |
|---|---|---|---|
| JP | 2003-192242 | A | 7/2003 |
| WO | WO 2011/117458 | A1 | 9/2011 |

* cited by examiner

15: Sway Measuring Device

17: Transmitter

18: Accelerometer

19: Gyroscope

15: Sway Measuring Device

17: Transmitter

18: Accelerometer

19: Gyroscope

ARRANGEMENT FOR DAMPING LATERAL SWAYS OF A ROPE FIXED TO AN ELEVATOR UNIT AND AN ELEVATOR

FIELD OF THE INVENTION

The invention relates to an elevator and an arrangement for damping lateral sways of rope-like means fixed to an elevator unit in an elevator hoistway. The elevator is particularly meant for transporting passengers and/or goods.

BACKGROUND OF THE INVENTION

Elevators have an elevator car moving in a vertical hoistway. In addition, elevators usually have a counterweight connected to the elevator car and moving in the hoistway. Typically, rope-like means fixed to the elevator units such as to the elevator car can be the travelling cable of an elevator, with which the necessary electrical energy is supplied to the elevator car and/or data is transmitted between the signaling devices of the elevator car, such as car call pushbuttons, communication devices and displays, and also the control system of the elevator. The rope-like means fixed to the elevator car can also be the compensating rope or compensating roping of an elevator used in high-rise buildings, in which case data and/or electricity does not necessarily travel in it.

When the high-speed elevators are used in high-rise buildings, vortices occur at high speeds in the elevator hoistway owing to the air resistance of the elevator car and vortices produce lateral movement in the travelling cable of the elevator and especially in the bottom loop of said cable. Sideways movement in the lateral direction of the travelling cable in high-rise buildings is also caused by movements of the elevator car itself and from swaying of the building caused mainly by wind. This type of lateral swaying is undesirable, because it increases the stressing of the travelling cable and produces noise and vibration or other discomfort to passengers of the elevator car.

Various sway damping solutions are known in the art, in which the travelling cable of the elevator is normally guided with various guides to travel along a certain path.

One aforementioned prior-art solution is presented in document WO 2011117458. In the document, a detachable damping means producing a mass effect is disposed to be supported by the top surface of the bottom loop for damping lateral sways of a rope-like means fixed to an elevator car in an elevator hoistway, the bottom end of which rope-like means comprises an upward opening bottom loop. A drawback of the solution is that during a storm, the travelling cable may sway quite heavily. Some travelling cables also twist, if they are not installed properly. Large lateral movement can cause the travelling cable to strike structures of the elevator hoistway, damaging hoistway devices or itself getting caught on them. In this case one consequence can even be a damage of an elevator causing an emergency stop of the elevator.

Another prior-art controller solution is presented in document JP 3013478 A. In the document, the bottom end of the travelling cable comprises a guide device of the travelling cable fixed to be supported by a separate suspension rope, which guide device travels up and down in the elevator hoistway along with the loop of the bottom end of the travelling cable. The part of the travelling cable on the side of the wall of the elevator hoistway is disposed in a vertical channel fixed to the wall and the free end rising to the elevator car after the loop of the bottom end is prevented from swaying by the aid of a horizontal guide arm in the guide device. A problem in this solution is that the solution is complex and expensive.

Additionally, the structure according to the solution comprises a lot of wearing parts, which can be damaged and cause, inter alia, servicing breaks, in which case the elevator must be taken out of use during the servicing or repair. For this reason, arrangement for damping lateral sways of a rope-like means fixed to an elevator car in an elevator hoistway has not been optimal.

BRIEF DESCRIPTION OF THE INVENTION

The object of the invention is, inter alia, to solve previously described drawbacks of known solutions and problems discussed later in the description of the invention. The object of the invention is to introduce an arrangement for damping sway of rope-like means, such as a travelling cable of an elevator, facilitating measurements of said cable movements and twisting, and stop the elevator if necessary.

In particular the object is to improve elevator safety by preventing large lateral movement of the travelling cable of an elevator. The large lateral movement of the travelling cable can cause the travelling cable to strike structures of the elevator hoistway, damaging hoistway devices or itself getting caught on them.

Embodiments are presented, inter alia, where the travelling cable sway measuring arrangement can prevent a damage of an elevator causing an emergency stop of the elevator. Furthermore, embodiments are presented, which facilitate installing the travelling cable sway measuring arrangement in the elevator. Furthermore, embodiments are presented, which enable cost effective way to implement the travelling cable sway measuring arrangement in the elevator.

It is brought forward a new arrangement for damping lateral sways of a rope-like means fixed to an elevator car in an elevator hoistway. In a preferred embodiment, rope-like means has an upward opening bottom loop in the bottom end of said elevator hoistway and a freely hanging damping means is supported on the top surface of said bottom loop said damping means comprising a device for measuring acceleration and/or twisting of said rope-like means. In this way, it is enabled to measure travelling cable movements and twisting, and stop the elevator if necessary. In this way, cable damage or other elevator damage following a possible entanglement of the cable can be prevented.

In a preferred embodiment, an accelerometer and a gyroscope are installed in the travelling cable sway reducer device. In this way, large lateral movement and twisting of the rope-like travelling cable of an elevator can be detected and cable damage or other elevator damage prevented.

In a preferred embodiment, said accelerometer measures lateral accelerations of said rope-like means in directions perpendicular to the direction of elevator moves, while said gyroscope measures loop twisting of said rope-like means. In this way, accurate values of lateral movement of the rope-like means, such as the travelling cable of an elevator can be measured.

In a preferred embodiment, said damping means comprises a Radio Frequency transmitter linked with a receiver located in the elevator hoistway. In this way, the values of acceleration and twisting of the rope-like means, such as travelling cable of an elevator can be sent wireless to the elevator controller.

In a preferred embodiment, acceleration and/or twisting measured by said device for measuring acceleration and/or twisting of said rope-like means are communicated to an elevator controller and if certain pre-set acceleration threshold value is exceeded or if twisting is detected, an alarm is triggered and predetermined actions for damping sway of said rope-like means, such as reduction of speed of the elevator or stop the elevator, are carried out. In this way, cable damage or other elevator damage is prevented.

In a preferred embodiment, said damping means comprises at least roller-like means mounted on bearings that allow rotation on an essentially horizontal axis, supported by which the damping means is arranged to move freely in relation to the top surface of the bottom loop in the direction of the longitudinal axis of the rope-like means when the elevator car moves upwards and downwards. In a preferred embodiment, said damping means also comprises a roller-like means below the bottom loop of the rope-like means, which roller-like means is mounted on bearings on an essentially horizontal axis, and in that all the roller-like means are fixed to each other into an essentially ring-like structure around the bottom loop by the aid of fixing means. In a preferred embodiment, in addition to the roller-like means supported by the top surface of the bottom loop and mounted on bearings on an essentially horizontal axis, said damping means comprises two other roller-like means mounted on bearings on an essentially vertical axis, one roller-like means on both sides of the rope-like means. In this way, said damping means can move smoothly along the rope-like means of the elevator.

In a preferred embodiment, the width of the bottom loop of the rope-like means is essentially greater than its thickness.

In a preferred embodiment, said damping means comprises roller-like means, of which roller-like means at least one, preferably all roller-like means are of a soft material at least on their surface.

In a preferred embodiment, said damping means comprises roller-like means, for which the vertical distance between the roller-like means is greater than the thickness of the bottom loop of the rope-like means and the horizontal distance between the roller-like means is greater than the width of the bottom loop of the rope-like means, and in that the bottom loop of the rope-like means is disposed in the vertical direction between the roller-like means and in the horizontal direction between the roller-like means.

In a preferred embodiment, said rope-like means is a flexible travelling cable between the car and a fixed point in the hoistway of an elevator.

In a preferred embodiment, said rope-like means is a compensating rope or compensating roping of an elevator.

It is also brought forward a new elevator. The elevator comprises a vertically movable elevator unit and an elevator hoistway and an arrangement for damping lateral sways of rope-like means fixed to an elevator car in an elevator hoistway. In a preferred embodiment, said movable elevator unit is an elevator car. In a preferred embodiment, rope-like means has an upward opening bottom loop in the bottom end of said elevator hoistway and a freely hanging damping means is supported on the top surface of said bottom loop said damping means comprising a device for measuring acceleration and/or twisting of said rope-like means. In this way, it is enabled to measure said rope-like means such as travelling cable movements and twisting, and stop the elevator if necessary. In this way, cable damage or other elevator damage following a possible entanglement of the cable can be prevented. The arrangement is as defined above or elsewhere in the application.

The benefits of the elevator are specified in context of the arrangement elsewhere in the application. Also, additional preferred features of the elevator are specified in context of the arrangement elsewhere in the application.

The elevator hoistway as described anywhere above is preferably, but not necessarily, inside a building. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
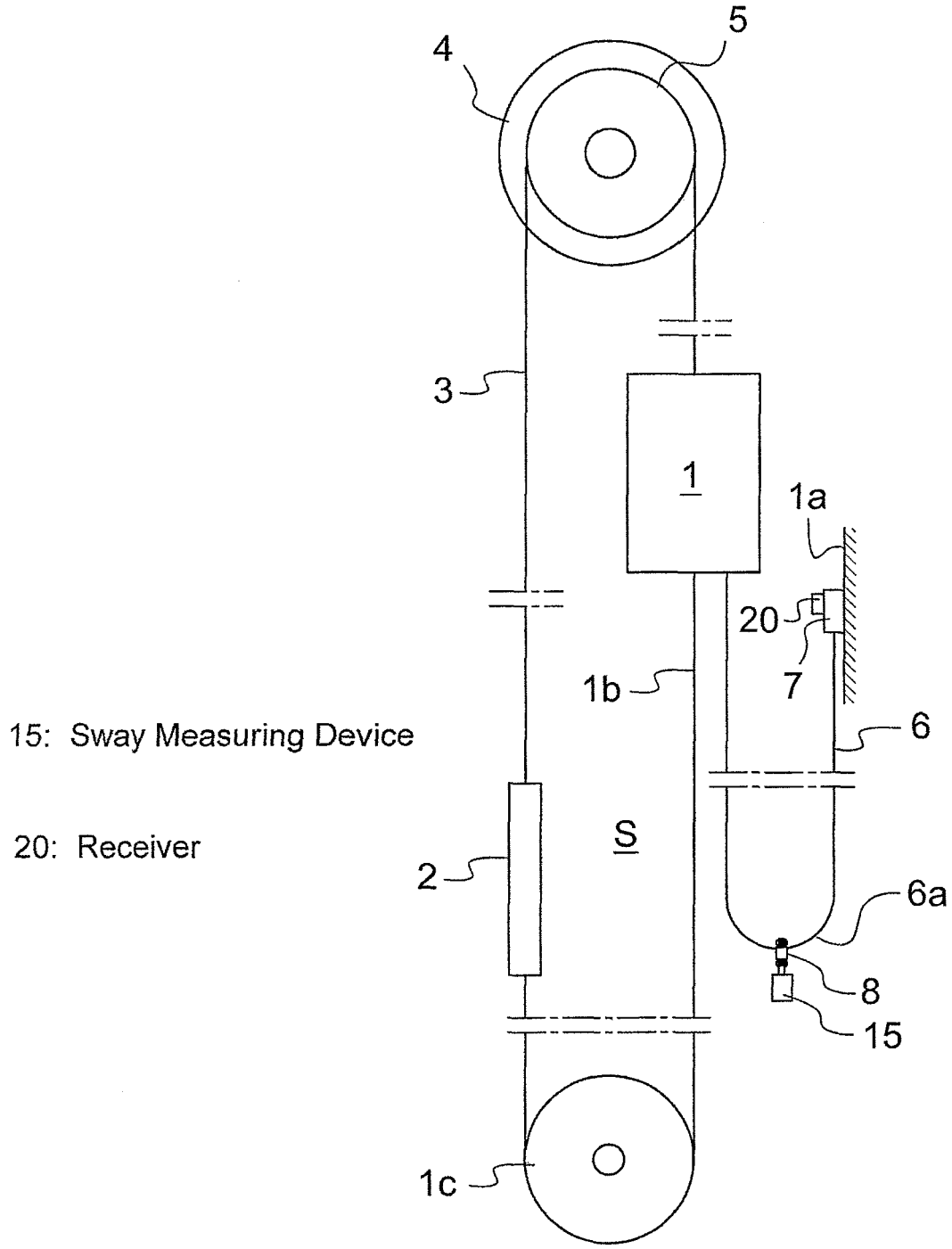
FIG. 1 illustrates schematically an elevator with an arrangement for damping lateral sways of a rope-like means according to the invention.

FIG. 1 illustrates a schematic view of an elevator with an arrangement for damping lateral sways of a rope-like means according to a preferred embodiment of the invention. The elevator comprises an elevator unit 1, 2 movable in the hoistway S. The movable elevator unit 1, 2 is in this embodiment an elevator car 1 and a counterweight 2 arranged to travel vertically in the hoistway S. Between an elevator car 1 and a counterweight 2 is fixed an elevator roping formed of elevator ropes 3 that are parallel to each other. Lifting means 3, 4, 5 comprise the elevator ropes 3 which ropes 3 are guided to pass over a lifting device 4, 5, i.e., a traction sheave 5 rotated by a hoisting machine 4 of the elevator in rope grooves dimensioned for the elevator ropes 3. As it rotates, the traction sheave 5 at the same time moves the elevator car 1 and the counterweight 2 in the up direction and down direction, due to friction. In addition, in high-rise buildings and in high-speed elevators there is a compensating rope 1*b*, formed from one or more parallel ropes, which is fixed at its first end to the bottom end of the counterweight 2 and at its second end to the bottom part of the elevator car 1, either to the car sling or to the car itself. The compensating rope 1*b* is kept taut, e.g. by means of a compensating pulley 1*c*, under which the compensating rope 1*b* passes around and which compensating pulley 1*c* is connected to a support structure on the base of the elevator hoistway, which support structure is not, however, shown in the figure.

The travelling cable 6, e.g. flat cable of cross-sectional shape, intended for the electricity supply of the elevator car and/or for data traffic is fixed at its first end to the elevator car 1, e.g. to the bottom part of the elevator car 1, and at its second end to a connection point 7 on the wall 1*a* of the elevator hoistway S, which connection point is typically at the point of the midpoint or above the midpoint of the height direction of the elevator hoistway S. From the elevator car 1 the travelling cable leaves at first downwards and then turns upwards towards its fixing point 7 of the second end forming a bottom loop 6*a* in its bottom part, which bottom loop hangs freely in the elevator hoistway S and moves in the hoistway S upwards and downwards along with the movement of the elevator car 1. According to the invention a detachable damping means 8 is disposed in the bottom loop 6*a* of the travelling cable 6, the mass effect caused by which damping means increases the moment of inertia of the bottom loop 6*a* and thereby damps the lateral sways of the bottom loop 6*a*.

The damping means 8 hangs as a free object in the bottom loop 6*a* and moves along with the bottom loop 6*a* downwards when the bottom loop 6*a* moves downwards and upwards when the bottom loop 6*a* moves upwards. In this application the attribute "hanging freely supported by the top surface of the bottom loop" means that the damping means hangs supported by the top surface, but is able to move in relation to the top surface of the bottom loop and the damping means is not supported in the lateral direction by any stationary fixed hoistway structure, such as e.g. by guide rails or by the floor or the walls of the elevator hoistway S. Preferably the damping means also is not supported by other ropes of the elevator than the rope-like means, supported by which it is suspended to hang freely.

For achieving suitable damping in elevators, the mass of the damping means 8 with or without additional weights is preferably 5-15 kg, preferably 5-10 kg, even more preferably 5-8 kg. The center of mass of the damping means 8 is preferably fitted to be essentially below the top roller 9, preferably at least a distance from the top roller, which distance is the width (horizontal direction) of the rope-like means 6+the thickness (vertical direction) of the rope-like means. In this way the damping means 8 behaves advantageously, and it does not have a rotation risk. The width of the rope-like means is preferably essentially greater than its thickness. In this way it stays against the roller 9 reliably. Likewise, the swaying of the damping means 8 in the bottom loop decreases.

Figure 2:
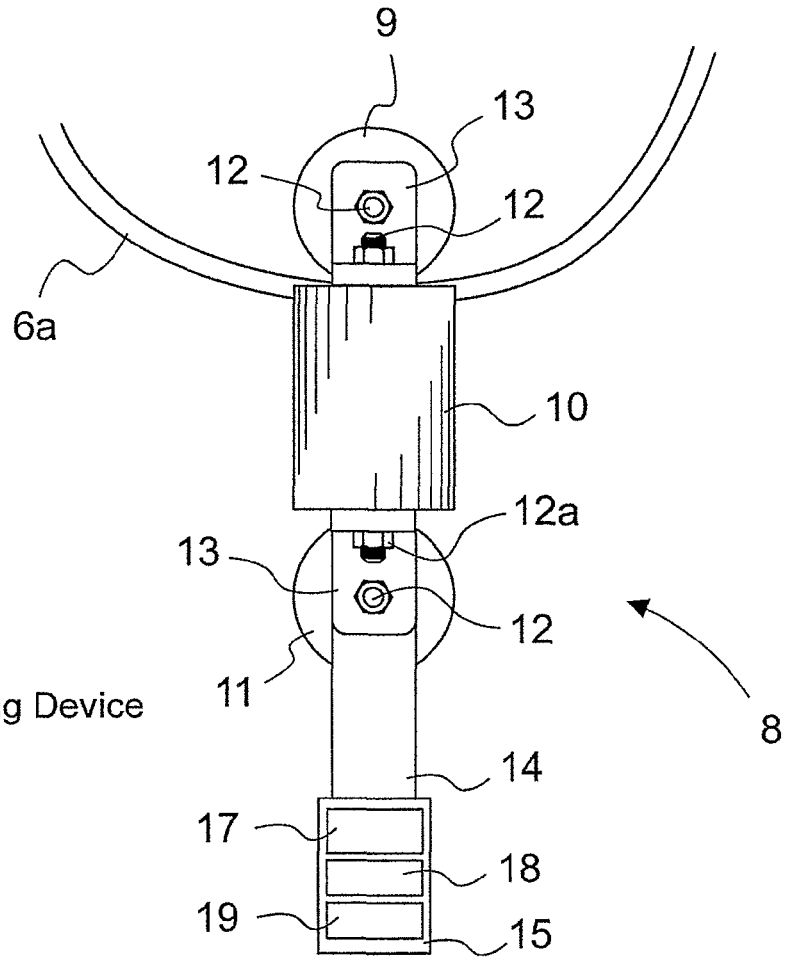
FIG. 2 illustrates a side view of a damping means according to the invention in its position in the bottom loop of the travelling cable arrangement according to an embodiment of the invention.
Figure 3:
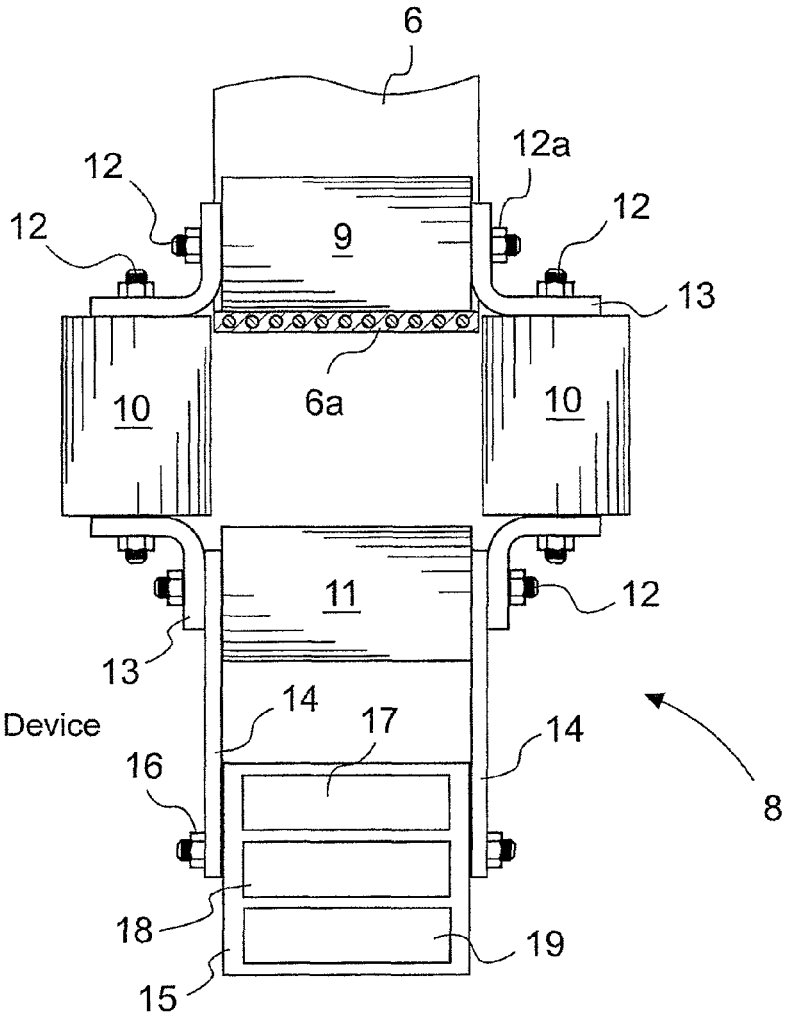
FIG. 3 illustrates front view of a damping means according to an embodiment of the invention in its position in the bottom loop of the travelling cable.

In the lower part of the damping means 8 is installed a box for a sway measuring device 15. The sway measuring device 15 communicates with the elevator using a low-cost Radio Frequency (RF) transmitter 17 installed in the box of the sway measuring device 15 as shown in FIGS. 2 and 3. The RF link is easy to implement, because there is always a line of sight between transmitter 17 and receiver 20 located in the lower part of the hoistway S, preferably at ¼ of the elevator travel.

FIGS. 2 and 3 present a magnified schematic view of the damping means 8 when it is in its position in the bottom loop 6*a* of the travelling cable 6. The damping means 8 consists of a plurality of rollers 9-11 that are essentially soft at least on their surface, of which rollers there are e.g. four units, which rollers 9-11 are fixed to each other into a ring with fixing means 13 forming a right angle, by the aid of bolts 12 and nuts 12*a*. Preferably the rollers 9-11 are arranged to rotate on bolts 12 that function as shafts. The top roller 9 and the bottom roller 11 are disposed, in terms of their axis, in an essentially horizontal position and the side rollers 10 are disposed, in terms of their axis, in an essentially vertical position. The top roller 9 is fitted to travel on top of the bottom loop 6*a* of the travelling cable 6 supported by the top surface of the bottom loop 6*a* and the bottom roller 11 is correspondingly fitted to travel below the bottom loop 6*a* of the travelling cable 6 such that between the bottom surface of the bottom loop 6*a* and the top surface of the bottom roller 11 is a vertical distance. The whole damping means 8 thus rests, freely supported by the top roller 9, on the top surface of the bottom loop 6*a*.

The horizontal distance between the side rollers 10 is greater than the width of the bottom loop 6*a* of the travelling cable 6 so that the damping means 8 would be able to move freely in relation to the bottom loop 6*a* when the bottom loop 6*a* ascends and descends. At least a part of the thickness of the bottom loop 6*a*, preferably the whole of the thickness of the bottom loop 6*a*, extends to below the top ends of the side rollers 10, in which case when the elevator car moves, the top ends of the side rollers 10 in turn strike the side surfaces of the bottom loop 6*a*.

Stem-like means 14 extending downwards are fitted to the shaft 12 of the bottom roller 11 on both sides of the ends of the bottom roller 11, which stem-like means are connected to each other with a pin-like suspension means at the bottom end of the stem-like means 14, at both ends of which suspension means are threads for fixing nuts 16. The suspension means is intended for placing the sway measuring device 15. Furthermore, in one embodiment of the invention, in addition to the sway measuring device 15, the suspension means is intended for placing additional weights in the damping means 8 when adjusting the damping means to be suitable for the structures and conditions.

The presence of a bottom roller 11 is not essential. Amongst other things, its presence facilitates servicing of the device, because it can easily be transferred, if necessary, to the place of the top roller 9.

An accelerometer 18 and a gyroscope 19 are installed in the box of the sway measuring device 15. Accelerometer 18 measures acceleration in lateral directions perpendicular to the direction elevator moves. If certain pre-set acceleration threshold value is exceeded, alarm is triggered. The gyroscope 19 is used to measure cable loop 6*a* twisting. If cable 6 is installed correctly, no angular movement should occur. If twisting, for some reason, is detected, an alarm is triggered. The sway measuring device 15 is preferably powered with a lithium battery, which provides power for preferably at least 5 years if modern low power electronics are used. Acceleration and/or twisting values measured by said sway measuring device 15 for said rope-like means 6 are communicated to an elevator controller and if an alarm is triggered, predetermined actions for damping sway of said rope-like means such as reducing speed of an elevator or stopping an elevator are carried out.

In the arrangement according to the invention the rope-like means 6 is preferably fixed to the bottom part of the elevator car 1, either to the car sling or to the car itself, such that the fixing point is at the point of the vertical projection of the inside space of the car, from which fixing point the rope-like means 6 descends downwards in the elevator hoistway S. Thus the rope-like means is not prone to colliding with the walls of the elevator hoistway.

The solution can also be utilized such that the rope-like means 6 is a compensating rope or compensating roping of an elevator. In this case the compensating rope 1*b* presented can be unnecessary.

The rollers 9-11 are essentially soft, at least on their surface, as mentioned previously. In this case the soft surface of the rollers 9-11 does not wear the travelling cable 6 when the damping means 8 moves in relation to the travelling cable 6 on the surface of the bottom loop 6*a*. On the inside the rollers 9-11 can be e.g. of metal for achieving the mass effect needed. It is obvious to the person skilled in the art that the invention is not limited to the embodiment example presented above, but that it may vary within the scope of the claims to be presented below. Thus, for example, the elevator can just as well be implemented without compensating ropes 1*b* and compensating pulley 1*c*.

It is further obvious to the person skilled in the art that the arrangement according to the invention can also be used in elevators without a counterweight and also in hydraulic elevators. It is further obvious to the person skilled in the art that the damping means can be structurally different to what is described above. The damping means can comprise, for example, fewer rollers than the four rollers presented above. For example, there can be only three rollers, in which case e.g. the bottom roller is omitted. It is further obvious to the person skilled in the art that the side rollers of the damping means do not necessarily need to be as high as what is presented in the figures. It is sufficient if there is suitably empty space below the bottom surface of the bottom loop of the travelling cable so that the bottom surface does not catch on the hard structures of the damping means.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An arrangement for damping lateral sways of a rope fixed to at least one elevator unit movable in a hoistway of an elevator including at least an elevator car, the elevator being suitable for transporting passengers and/or goods, the bottom end of the rope having an upward opening bottom loop, which arrangement comprises a freely hanging damper supported on a top surface of the bottom loop, wherein said damper comprises a device for measuring acceleration and/or twisting of said rope, wherein acceleration and/or twisting values measured by said device for said rope are communicated to an elevator controller and if a certain pre-set acceleration threshold value is exceeded or if twisting is detected, an alarm is triggered and predetermined actions for damping sway of said rope are carried out.

2. The arrangement according to claim 1, wherein said device for measuring acceleration of said rope comprises an accelerometer measuring lateral accelerations of said rope in directions perpendicular to the direction of elevator movement.

3. The arrangement according to claim 1, wherein said device for measuring twisting of said rope comprises a gyroscope for measuring loop twisting of said rope.

4. The arrangement according to claim 1, wherein said damper comprises a Radio Frequency transmitter linked with a receiver located in the elevator hoistway.

5. The arrangement according to claim 1, wherein if a certain pre-set acceleration threshold value is exceeded or if twisting is detected, a speed of said elevator is reduced or said elevator is stopped.

6. The arrangement according to claim 1, wherein said damper comprises at least a roller mounted on bearings that allow rotation on an essentially horizontal axis, supported by which the damper is arranged to move freely in relation to the top surface of the bottom loop in the direction of the longitudinal axis of the rope when the elevator car moves upwards and downwards.

7. The arrangement according to claim 6, wherein said damper also comprises a roller below the bottom loop of the rope, which roller is mounted on bearings on an essentially horizontal axis, and the rollers are fixed to each other into an essentially ring-like structure around the bottom loop by the aid of a fixing device.

8. The arrangement according to claim 6, wherein in addition to roller supported by the top surface of the bottom loop and mounted on bearings on an essentially horizontal axis, said damper comprises two rollers mounted on bearings on an essentially vertical axis, one roller on both sides of the rope.

9. The arrangement according to claim 1, wherein the width of the bottom loop of the rope is essentially greater than its thickness.

10. The arrangement according to claim 1, wherein said damper comprises at least one roller made of a soft material at least on a surface thereof.

11. The arrangement according to claim 1, wherein said damper comprises a first roller, a second roller and third rollers, wherein a vertical distance between the first and second rollers is greater than a thickness of the bottom loop of the rope and the horizontal distance between the third rollers is greater than a width of the bottom loop of the rope, and the bottom loop of the rope is disposed in the vertical direction between the first and second ropes and in the horizontal direction between the third rollers.

12. The arrangement according to claim 1, wherein said rope is the travelling cable of an elevator.

13. The arrangement according to claim 1, wherein the rope is a compensating rope or compensating roping of an elevator.

14. An elevator suitable for transporting passengers and/or goods, which elevator comprises:

a hoistway, at least one elevator unit movable in the hoistway, including at least an elevator car, a lifting device, and one or more ropes fixed to the movable elevator unit, wherein damping of lateral sways of a rope fixed to said elevator unit is arranged with an arrangement according to claim 1.

15. The arrangement according to claim 2, wherein said device for measuring twisting of said rope comprises a gyroscope for measuring loop twisting of said rope.

16. The arrangement according to claim 2, wherein said damping means comprises a Radio Frequency transmitter linked with a receiver located in the elevator hoistway.

17. The arrangement according to claim 3, wherein said damping means comprises a Radio Frequency transmitter linked with a receiver located in the elevator hoistway.

* * * * *